US011843158B2

(12) United States Patent
Gu et al.

(10) Patent No.: US 11,843,158 B2
(45) Date of Patent: Dec. 12, 2023

(54) TRISECTION POWER DIVIDER WITH ISOLATION AND MICROWAVE TRANSMISSION SYSTEM

(71) Applicant: The 13th Research Institute of China Electronics Technology Group Corporation, Shijiazhuang (CN)

(72) Inventors: Zhanbiao Gu, Shijiazhuang (CN); Hongmin Gao, Shijiazhuang (CN); Zhiliang Zhang, Shijiazhuang (CN); Xiaoyong Ren, Shijiazhuang (CN); Qianhong Chen, Shijiazhuang (CN); Shujie Wang, Shijiazhuang (CN); Chao Tan, Shijiazhuang (CN); Senfeng Xu, Shijiazhuang (CN)

(73) Assignee: The 13th Research Institute of China Electronics Technology Group Corporation, Shijiazhuang (CN)

( * ) Notice: Subject to any disclaimer, the term of this patent is extended or adjusted under 35 U.S.C. 154(b) by 0 days.

(21) Appl. No.: 18/196,809

(22) Filed: May 12, 2023

(65) Prior Publication Data

US 2023/0344107 A1 Oct. 26, 2023

Related U.S. Application Data

(63) Continuation of application No. PCT/CN2022/111604, filed on Aug. 11, 2022.

(30) Foreign Application Priority Data

Apr. 21, 2022 (CN) ..... 202210423845.6

(51) Int. Cl.
*H01P 5/22* (2006.01)

(52) U.S. Cl.
CPC ..... *H01P 5/22* (2013.01)

(58) Field of Classification Search
CPC ..... H01P 5/22
(Continued)

(56) References Cited

U.S. PATENT DOCUMENTS 4,636,755 A * 1/1987 Gibbs ..... H01P 5/16 333/120
2012/0293274 A1 11/2012 Song et al.

FOREIGN PATENT DOCUMENTS

CN 103762408 A 4/2014
CN 107959097 A 4/2018
(Continued)

OTHER PUBLICATIONS

International Search Report and Written Opinion received in Patent Cooperation Treaty Application No. PCT/CN2022/111604, dated Dec. 27, 2022, 8 pages.
(Continued)

*Primary Examiner* — Rakesh B Patel
*Assistant Examiner* — Jorge L Salazar, Jr.
(74) *Attorney, Agent, or Firm* — AP3 Law Firm PLLC

(57) ABSTRACT

The present application provides a trisection power divider with isolation and a microwave transmission system, where the divider includes a first hybrid ring coupler with a distribution ratio of 1:2 and a second hybrid ring coupler with a distribution ratio of 1:1; a first port of the first hybrid ring coupler is a signal input port; a second port of the first hybrid ring coupler is connected with a first port of the second hybrid ring coupler; a second port of the second hybrid ring coupler, a third port of the second hybrid ring coupler and a third port of the first hybrid ring coupler are three signal output ports of the divider; and the second port of the first hybrid ring coupler is a port with high power.

18 Claims, 5 Drawing Sheets

(58) Field of Classification Search
USPC ..... 333/109, 112, 116–118, 238, 246
See application file for complete search history.

(56) References Cited

FOREIGN PATENT DOCUMENTS

| | | | |
|---|---|---|---|
| KR | 102046408 | B1 | 11/2019 |
| TW | 201229549 | A | 7/2012 |

OTHER PUBLICATIONS

Laihui, Han, et al., "Design and Analysis of Binary Wide-Band MMW Combiner", Fire Control Radar Technology, vol. 45, No. 2 (Series 176), Jun. 2016, English abstract.
Pengju, Lu, et al., "Design and Implementation of Broadband Microwave Solid State Power Amplifier Based on Hybrid Ring Power Divider/Combiner Network", Gansu Science and Technology, vol. 30, No. 22, Nov. 2014, English abstract.

* cited by examiner

TRISECTION POWER DIVIDER WITH ISOLATION AND MICROWAVE TRANSMISSION SYSTEM

CROSS-REFERENCE TO RELATED APPLICATIONS

This application is a continuation of International Application No. PCT/CN2022/111604, filed on Aug. 11, 2022, which claims priority to Chinese Patent Application No. 202210423845.6, filed on Apr. 21, 2022. The disclosures of the aforementioned applications are hereby incorporated by reference in their entireties.

TECHNICAL FIELD

The present application relates to the technical field of microwave, and particularly relates to a trisection power divider with isolation and a microwave transmission system.

BACKGROUND

The power combiner is a circuit that combines multiple input signal energy into one signal energy output. On the contrary, the circuit that divides one input signal energy into multiple signal energy output is called power divider. Power divider/combiner is an extremely important component in microwave system. Whether in microwave communication, telemetry and remote sensing, radar or electronic warfare systems, signal power division/combination is extremely important.

In the microwave transmission system, it is often encountered that the output power of a single microwave active device cannot meet the demand, and multi-channel power combination must be carried out to meet the demand. In high-power plane power combination, the overall power, the efficiency and the size should be considered comprehensively. Odd-number power combination, especially three-way power combination, is widely used. In turn, the same problems are faced in power division.

However, at present, the performance of the trisection microstrip power divider/combiner is poor and cannot meet the requirements of the microwave transmission system.

SUMMARY

These and other problems are generally solved or circumvented, and technical advantages are generally achieved, by embodiments of the present application which provide a trisection power divider with isolation and a microwave transmission system.

Technical Problems

The present application provides a trisection power divider with isolation and a microwave transmission system to solve the problem that the performance of the trisection microstrip power divider/combiner is poor and cannot meet the requirements of the microwave transmission system.

Technical Solutions

In a first aspect, embodiments of the present application provide a trisection power divider with isolation including: a first hybrid ring coupler with a distribution ratio of 1:2; and a second hybrid ring coupler with a distribution ratio of 1:1; and where a first port of the first hybrid ring coupler is a signal input port; a second port of the first hybrid ring coupler is connected with a first port of the second hybrid ring coupler; a second port of the second hybrid ring coupler, a third port of the second hybrid ring coupler and a third port of the first hybrid ring coupler are three signal output ports of the trisection power divider; and the second port of the first hybrid ring coupler is a port with high power, and a fourth port of the first hybrid ring coupler and a fourth port of the second hybrid ring coupler are isolation ports.

In one possible implementation, the first hybrid ring coupler and the second hybrid ring coupler are circular hybrid ring couplers.

In one possible implementation, the first hybrid ring coupler is a first closed hybrid ring coupler, the first closed hybrid ring coupler including two arcs that are symmetrically arranged and two edges connected between the two arcs, the two arcs being a first arc and a second arc, and the two edges being a first edge and a second edge in parallel to each other; and the second port of the first hybrid ring coupler is arranged on the first edge and perpendicular to the first edge, and the third port of the first hybrid ring coupler is arranged on the second edge and perpendicular to the second edge; or the second hybrid ring coupler is a second closed hybrid ring coupler, the second closed hybrid ring coupler including two arcs that are symmetrically arranged and two edges connected between the two arcs, the two arcs being a first arc and a second arc, and the two edges being a first edge and a second edge in parallel to each other; and the second port of the second hybrid ring coupler is arranged on the first edge and perpendicular to the first edge, and the third port of the second hybrid ring coupler is arranged on the second edge and perpendicular to the second edge.

In one possible implementation, the first port of the first hybrid ring coupler is arranged on the first arc or the second arc of the first hybrid ring coupler, and is aligned with a symmetry axis of the first arc or the second arc of the first hybrid ring coupler; and the second port of the first hybrid ring coupler and the third port of the first hybrid ring coupler are symmetrically arranged to the first port of the first hybrid ring coupler; or the first port of the second hybrid ring coupler is arranged on the first arc or the second arc of the second hybrid ring coupler, and is aligned with a symmetry axis of the first arc or the second arc of the second hybrid ring coupler; and the second port of the second hybrid ring coupler and the third port of the second hybrid ring coupler are symmetrically arranged to the first port of the second hybrid ring coupler.

In one possible implementation, the fourth port of the first hybrid ring coupler and the third port of the first hybrid ring coupler are on a same edge of the first hybrid ring coupler; or the fourth port of the second hybrid ring coupler and the third port of the second hybrid ring coupler are on a same edge of the second hybrid ring coupler.

In one possible implementation, the second port of the first hybrid ring coupler, the third port of the first hybrid ring coupler, the second port of the second hybrid ring coupler and third port of the second hybrid ring coupler are directly connected with microstrip lines, respectively; a first end of a first microstrip line connected with the second port of the first hybrid ring coupler is perpendicular to the first edge of the first hybrid ring coupler, and a second end of the first microstrip line is bent away from the first port of the first hybrid ring coupler; a first end of a second microstrip line connected with the third port of the first hybrid ring coupler is perpendicular to the second edge of the first hybrid ring coupler, and a second end of the second microstrip line is bent away from the first port of the first hybrid ring coupler;

a first end of a third microstrip line connected with the second port of the second hybrid ring coupler is perpendicular to the first edge of the second hybrid ring coupler, and a second end of the third microstrip line is bent away from the first port of the second hybrid ring coupler; and a first end of a fourth microstrip line of the third port of the second hybrid ring coupler is perpendicular to the second edge of the second hybrid ring coupler, and a second end of the fourth microstrip line is bent away from the first port of the second hybrid ring coupler.

In one possible implementation, the first port of the first hybrid ring coupler, the fourth port of the first hybrid ring coupler, the first port of the second hybrid ring coupler and the fourth port of the second hybrid ring coupler are externally connected with 50Ω microstrip lines, respectively.

In one possible implementation, the second port of the first hybrid ring coupler and the third port of the first hybrid ring are externally connected with 50Ω microstrip lines of a same length, respectively; and the second port of the second hybrid ring coupler and the third port of the second hybrid ring coupler are externally connected with 50Ω microstrip lines of a same length, respectively.

In one possible implementation, the second port of the first hybrid ring coupler, the third port of the first hybrid ring coupler, the second port of the second hybrid ring coupler and the third port of the second hybrid ring coupler are externally connected with 50Ω microstrip lines of a same length, respectively.

In a second aspect, embodiments of the present application further provide a microwave transmission system, wherein the microwave transmission system includes the trisection power divider with isolation according to anyone of the embodiments of the first aspect.

Advantageous Effects of the Disclosure

Embodiments of the present application provide a trisection power divider with isolation and a microwave transmission system. By replacing the common Wilkinson power divider with a hybrid ring coupler with isolation, the isolation degree of the trisection power divider is guaranteed and the device can work stably. The trisection power divider with isolation has simple structure and high performance.

BRIEF DESCRIPTION OF THE DRAWINGS

In order to more clearly illustrate the technical solutions in the embodiments of the present application, the following description briefly introduces the drawings used in the embodiments or the prior art, and it is obvious that the drawings in the following description are only some embodiments of the present application, and that other drawings can be obtained from these drawings by a person skilled in the art without involving any inventive effort.

The following provides the note of the attached drawings.

In the FIG. 2 to FIG. 5, in the first hybrid ring coupler: 11—first port, 12—second port, 13—third port, 14—fourth port, 15—first arc, 16—first arc, 17—first edge, 18—second edge, 191—first microstrip line, 192—second microstrip line.

In the FIG. 2 to FIG. 5, in the second hybrid ring coupler: 21—first port, 22—second port, 23—third port, 24—fourth port, 25—first arc, 26—second arc, 27—first edge, 28—second edge, 291—third microstrip line, 292—fourth microstrip line.

Figure 4:
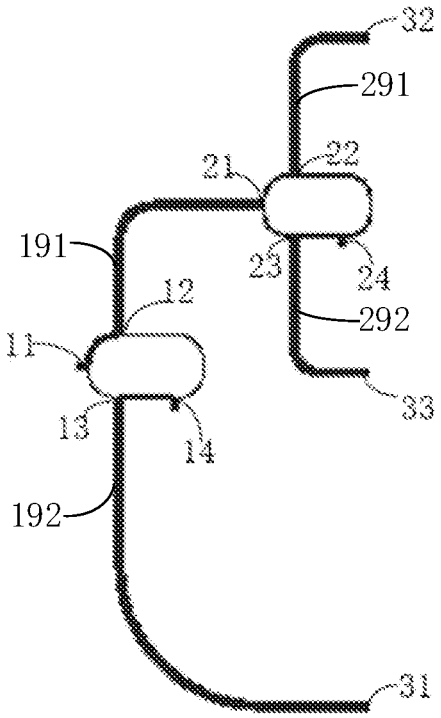
FIG. 4 is a structure schematic diagram of a trisection power divider with isolation provided by one embodiment of the present application.
Figure 5:
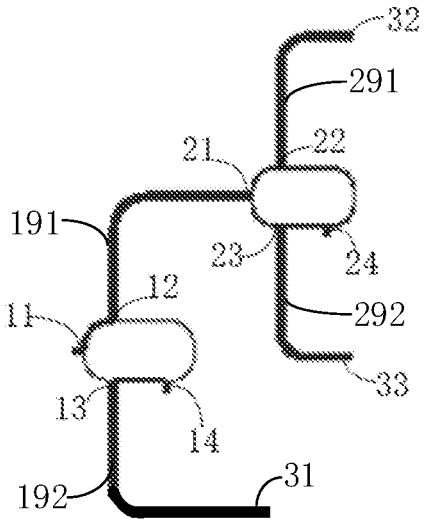
FIG. 5 is a structure schematic diagram of a trisection power divider with isolation provided by another embodiment of the present application.

In the FIG. 4 and FIG. 5, 31—first output port, 32—second output port, 33—third output port.

Figure 6:
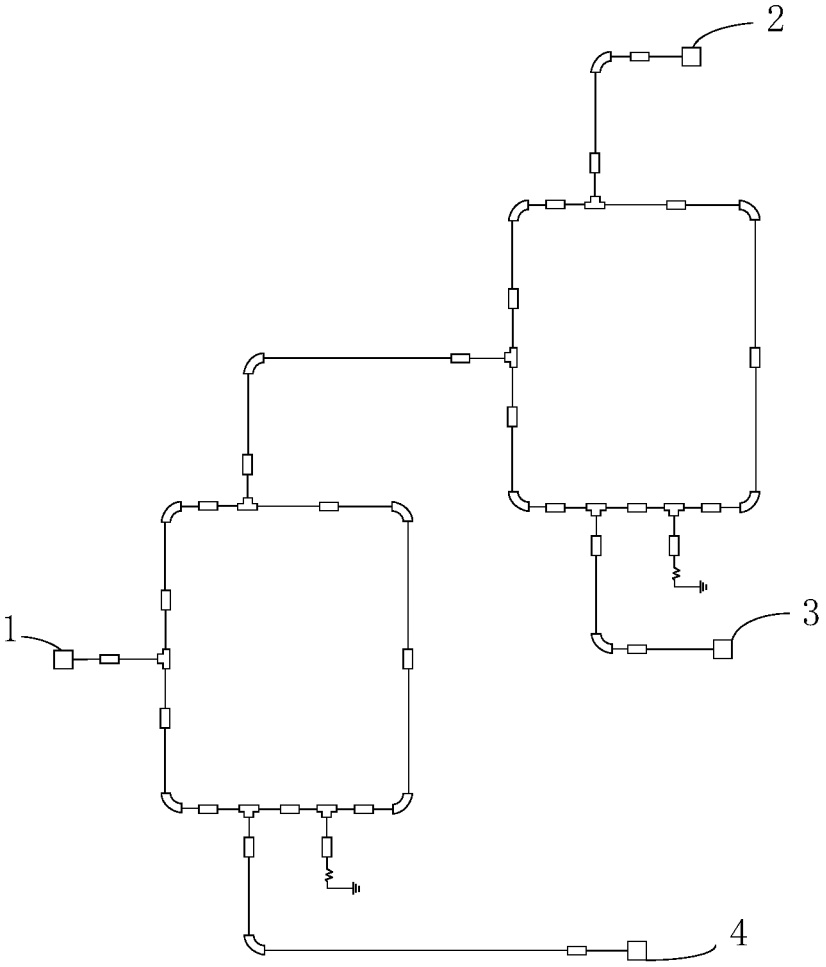
FIG. 6 is a structure schematic diagram of a simulation model of a trisection power divider with isolation provided by one embodiment of the present application.

In the FIG. 6, 1—signal input port, 2, 3, 4—signal output port.

DETAILED DESCRIPTION OF ILLUSTRATIVE EMBODIMENTS

In the following description, specific details such as specific system structure and technology are proposed for the purpose of illustration rather than limitation, so as to thoroughly understand the embodiments of the present application. However, those skilled in the art should be aware that the present application can also be implemented in other embodiments without these specific details. In other cases, the detailed description of well-known systems, devices, circuits and methods is omitted, so as to avoid unnecessary details impeding the description of the present application. In this paper, "A or B" refers to feature A, feature B, or the combination of feature A and feature B.

In order to make the purpose, technical scheme and advantages of the present application clearer, the following will be explained by specific embodiments in combination with the attached drawings.

As described in the background technology, in general, the three output ports of the three-way power divider are not isolated from each other, and the imbalance of amplitude and phase between the three output ports can easily cause the unstable operation of the device, and the three output ports will also be affected by the layout wiring and interfere with each other.

In order to solve the technical problems of the prior art, the embodiments of the present application provide a trisection power divider with isolation and a microwave transmission system. The trisection power divider with isolation provided by the embodiments of the present application will be introduced in the following.

It has been noticed that the current power divider/combiner composed of Wilkinson couplers with a power distribution ratio of 1:2 and 1:1 has very poor isolation, which affects the normal operation of the device.

Figure 1:
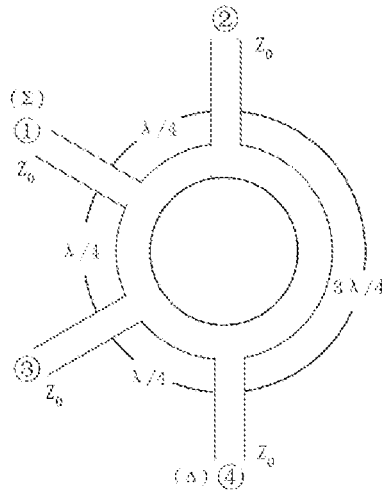
Fig. 1 (Prior art)
FIG. 1 is a structure schematic diagram of a currently commonly used hybrid ring coupler.

As shown in FIG. 1, the commonly used hybrid ring coupler is a four-port network, which can be made of microstrip lines. The circumference of the whole ring is 1.5λ, four branch lines are connected in parallel on the ring, which is divided into four sections. When the signal is input form the port ② of the hybrid ring coupler, the signal is output from the ports ① and ④ in reverse phase according to a certain power distribution ratio, while the port ③ has no output theoretically and is the isolation port. Conversely, if the signal is input form the port ①, the ports ② and ③ are output in phase according to a certain power distribution ratio, while the port ④ has no output. Therefore, the ports ① and ④ are isolated from each other, and the ports ② and ③ are also isolated from each other.

In order to solve the problems of the prior art, the embodiments of the present application provide a trisection power divider with isolation and a microwave transmission system. Below is an introduction to the trisection power divider with isolation. It is apparent to those of ordinary skill in the art that when the power divider is used as a power combiner, the roles of the signal input port and the signal output port can be replaced, and the isolation principle of the power divider and the power combiner is the same.

The embodiments of the present application provide a trisection power divider with isolation, and the trisection power divider includes a first hybrid ring coupler with a distribution ratio of 1:2 and a second hybrid ring coupler with a distribution ratio of 1:1.

Where a first port 11 of the first hybrid ring coupler is a signal input port; a second port 12 of the first hybrid ring coupler is connected with a first port 21 of the second hybrid ring coupler; a second port 22 of the second hybrid ring coupler, a third port 23 of the second hybrid ring coupler and a third port 13 of the first hybrid ring coupler are three output ports of the trisection power divider. Specifically, the second port 12 of the first hybrid ring coupler is a port with high power, and a fourth port 14 of the first hybrid ring coupler and a fourth port 24 of the second hybrid ring coupler are isolation ports.

It should be noted that as shown in FIGS. 2 to 5, the first port (11, 21) is located between the second port (12, 22) and the third port (13, 23), and the fourth port (14, 24) is also located between the second port (12, 22) and the third port (13, 23). However, the first port (11, 21) and the fourth port (14, 24) are located on different sides, that is, the port wrapping order of the first hybrid ring coupler is the first port 11, the second port 12, the fourth port 14 and the third port 13 in a clockwise direction; and the port wrapping order of the second hybrid ring coupler is the first port 21, the second port 22, the fourth port 24 and the third port 23 in a clockwise direction.

Figure 2:
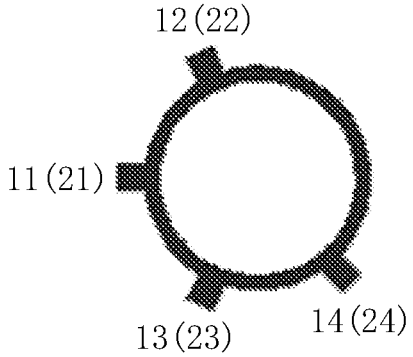
FIG. 2 is a structure schematic diagram of a circular hybrid ring coupler provided by one embodiment of the present application.

FIG. 2 shows a circular hybrid ring coupler used in the embodiment of the present application, which may adopt a first hybrid ring coupler with a distribution ratio of 1:2 and a second hybrid ring coupler with a distribution ratio of 1:1. Where the first hybrid ring coupler and the second hybrid ring coupler are both circular hybrid ring couplers. The circular hybrid ring coupler includes a first port (11, 21), a second port (12, 22), a third port (13, 23) and a fourth port (14, 24) arranged in a clockwise direction. As shown in FIG. 4 and FIG. 5, by changing the transformation impedance of the first port 11 to the second port 12 and the third port 13 of the first hybrid ring coupler, as well as the transformation impedance of the first port 21 to the second port 22 and the third port 23 of the second hybrid ring coupler, that is, the transformation impedance of the input port to the output port, two hybrid ring couplers with different output ratios may be formed.

However, when both the first hybrid ring coupler and the second hybrid ring coupler are circular hybrid ring couplers, there will be a certain angle between the microstrip lines from the second port (12, 22) and the third port (13, 23), and the angle is irregular. When the required phase of the trisection power divider/combiner needs to be consistent, layout and wiring are more difficult.

Figure 3:
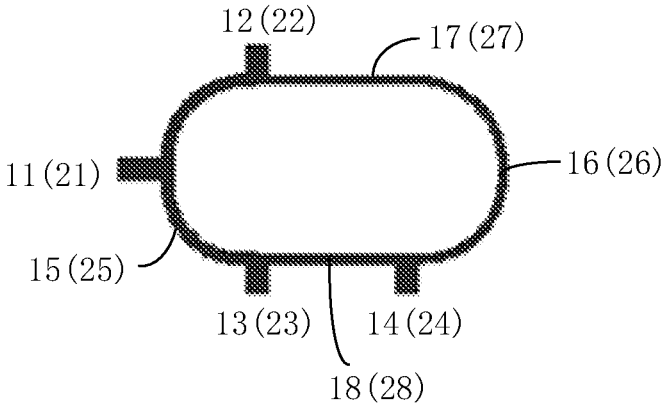
FIG. 3 is a structure schematic diagram of a newly hybrid ring coupler provided by another embodiment of the present application.

In order to ensure the phase consistency and ease of layout and wiring of the trisection power divider/combiner, embodiments of the present application also provide a hybrid ring coupler similar to a runway shape, as shown in FIG. 3. The first hybrid ring coupler is a first closed hybrid ring coupler, the first closed hybrid ring coupler including two arcs that are symmetrically arranged and two edges connected between the two arcs, the two arcs being a first arc 15 and a second arc 16, and the two edges being a first edge 17 and a second edge 18 in parallel to each other. The second hybrid ring coupler is a second closed hybrid ring coupler, the second closed hybrid ring coupler including two arcs that are symmetrically arranged and two edges connected between the two arcs, the two arcs being a first arc 25 and a second arc 26, and the two edges being a first edge 27 and a second edge 28 in parallel to each other. Combining the structures shown in FIG. 4 and FIG. 5, the output ports of the first hybrid ring coupler, namely corresponding second port 12 and corresponding third port 13, are respectively arranged on the two edges and are perpendicular to corresponding edges, that is, the second port 12 is perpendicular to the first edge 17, and the third port 13 is perpendicular to the second edge 18; or the output ports of the second hybrid ring coupler, namely corresponding second port 22 and corresponding third port 23, are respectively arranged on the two edges and are perpendicular to corresponding edges, that is, the second port 22 is perpendicular to the first edge 27, and the third port 23 is perpendicular to the second edge 28. Due to the parallel arrangement of the first edge (17, 27) and the second edge (18, 28), they may also be referred to as a first parallel edge and a second parallel edge, respectively.

In order to ensure consistent phase and easy layout, as shown in FIG. 3 to FIG. 5, the first port 11 of the first hybrid ring coupler is arranged on one of the two arcs and aligned with a symmetry axis of a corresponding arc, that is, the first port 11 may be arranged on the first arc 15 or the second arc 16 of the first hybrid ring coupler, and may be aligned with the symmetry axis of the first arc 15 or the second arc 16 of the first hybrid ring coupler; or the first port 21 of the second hybrid ring coupler is arranged on one of the two arcs and aligned with a symmetry axis of a corresponding arc, that is, the first port 21 may be arranged on the first arc 25 or the second arc 26 of the second hybrid ring coupler, and may be aligned with the symmetry axis of the first arc 25 or the second arc 26 of the second hybrid ring coupler. The second port 12 of the first hybrid ring coupler and the third port 13 of the first hybrid ring coupler are symmetrically arranged to the first port 11 of the first hybrid ring coupler; or the second port 22 of the second hybrid ring coupler and the third port 23 of the second hybrid ring coupler are symmetrically arranged to the first port 21 of the second hybrid ring coupler. That is, the symmetry axis of the second port (12, 22) and the third port (13, 23) passes through the first port (11, 21). The fourth port 14 of the first hybrid ring coupler and the third port 13 of the first hybrid ring coupler are on a same edge of the first hybrid ring coupler, that is, both are located on the second edge 18; or the fourth port 24 of the second hybrid ring coupler and the third port 23 of the second hybrid ring coupler are on a same edge of the second hybrid ring coupler, that is, both are located on the second edge 28.

In some embodiments, a trisection power divider with isolation as shown in FIG. 4 and FIG. 5 includes a first hybrid ring coupler with a distribution ratio of 1:2 and a second hybrid ring coupler with a distribution ratio of 1:1.

Where a first port 11 of the first hybrid ring coupler is a signal input port; a second port 12 of the first hybrid ring coupler is connected with a first port 21 of the second hybrid ring coupler; a second port 22 of the second hybrid ring coupler, a third port 23 of the second hybrid ring coupler and a third port 13 of the first hybrid ring coupler are three output ports of the trisection power divider. The second port 12 of the first hybrid ring coupler is a port with high power, and a fourth port 14 of the first hybrid ring coupler and a fourth port 24 of the second hybrid ring coupler are isolation ports.

Combining the structure shown in FIG. 3 to FIG. 5, the first hybrid ring coupler and the second hybrid ring coupler are closed hybrid ring couplers, and both include two arcs that are symmetrically arranged and two edges connected between the two arcs. The second port 12 of the first hybrid ring coupler and the third port 13 of the first hybrid ring coupler are respectively arranged on the two edges and perpendicular to corresponding edges. The second port 22 of the second hybrid ring coupler and the third port 23 of the second hybrid ring coupler are respectively arranged on the two edges and perpendicular to corresponding edges. The first port 11 of the first hybrid ring coupler is arranged on one of the two arcs and aligned with a symmetry axis of a corresponding arc; and the first port 21 of the second hybrid ring coupler is arranged on one of the two arcs and aligned with a symmetry axis of a corresponding arc. The second port 12 of the first hybrid ring coupler and the third port 13 of the first hybrid ring coupler are symmetrically arranged to the first port 11 of the first hybrid ring coupler, and the second port 22 of the second hybrid ring coupler and the third port 23 of the second hybrid ring coupler are symmetrically arranged to the first port 21 of the second hybrid ring coupler. In the first hybrid ring coupler, the fourth port 14 is an isolation port, and the fourth port 14 and the third port 13 are on a same edge; in the second hybrid ring coupler, the fourth 24 is an isolation port, and the fourth port 24 and the third port 23 also are on a same edge.

By adjusting the length of the microstrip line between the first hybrid ring coupler and the second hybrid ring coupler, the phases of the three signal output ports can be aligned, thereby improving the performance of the trisection power divider with isolation.

Four ports of the first hybrid ring coupler and four ports of the second hybrid ring coupler are respectively connected with 50Ω (Ω refers to ohm, which is the unit of impedance) microstrip lines. In order to ensure the consistency phase of the second port (12, 22) and the third port (13, 23), the second port 12 of the first hybrid ring coupler and the third port 13 of the first hybrid ring may be respectively and externally connected with 50Ω microstrip lines of the same length perpendicular to the corresponding parallel edges, that is, at least one end of each microstrip line is perpendicular to the corresponding parallel edge. The second port 22 of the second hybrid ring coupler and the third port 23 of the second hybrid ring may be respectively and externally connected with 50Ω microstrip lines of the same length perpendicular to the corresponding parallel edges, that is, at least one end of each microstrip line is perpendicular to the corresponding parallel edge. According to the performance requirements of the trisection power divider, 50Ω microstrip lines with the same length can be externally connected at the second port 12 and the third port 13 of the first hybrid ring coupler and the second port 22 and the third port 23 of the second hybrid ring coupler, respectively, that is, the length of the 50Ω micro strip lines at all four ports is the same.

The second port 12 of the first hybrid ring coupler is connected to the first port 21 of the second hybrid ring coupler through an external 50Ω microstrip line, which is named a first microstrip line 191; and the first microstrip line 191 connected with the second port 12 is perpendicular to the corresponding parallel edge, that is, a first end of the first microstrip line 191 is perpendicular to the first edge 17 of the first hybrid ring coupler, and a second end of the first microstrip line 191 is smoothly bent away from the first port 11 of the first hybrid ring coupler. The third port 13 of the first hybrid ring coupler is externally connected with a 50Ω micro strip line, which is named a second microstrip line 192; and one end of the second microstrip line 192 is perpendicular to the corresponding parallel edge, that is, a first end of the second microstrip line is perpendicular to the second edge 18 of the first hybrid ring coupler, and a second end of the second microstrip line is smoothly bent away from the first port 11, forming the first output port 31 of the trisection power divider with isolation. The first port 11 of the first hybrid ring coupler is externally connected with a 50Ω microstrip line, forming a signal input port with trisection power divider with isolation. And the length of the first microstrip line 191 connected with the second port 12 of the first hybrid ring coupler and the length of the second microstrip line 192 connected with the third port 13 of the first hybrid ring coupler are the same.

The microstrip line connected with the second port 22 of the second hybrid ring coupler is perpendicular to the corresponding parallel edge, and the microstrip line connected with the second port 22 is named a third microstrip line 291, that is, a first end of the third microstrip line 291 is perpendicular to the first edge 27, and a second end of the third microstrip line 291 is smoothly bent away from the first port 21, forming the second output port 32 of the trisection power divider. The third port 23 of the second hybrid ring coupler is externally connected with a 50Ω microstrip line, which is named a fourth microstrip line 292; and one end of the fourth microstrip line 292 is perpendicular to the corresponding parallel edge, that is, a first end of the fourth microstrip line 292 is perpendicular to the second edge 28, and a second end of the fourth microstrip line 292 is smoothly bent away from the first port 21, forming the third output port 33 of the trisection power divider. And the length of the third microstrip line 291 connected with the second port 22 of the second hybrid ring coupler and the length of the fourth microstrip line 292 connected with the third port 23 of the second hybrid ring coupler are the same. The first output port 31, the second output port 32, and the third output port 33 form three signal output ports.

In order to achieve better phase consistency of the trisection power divider with isolation, four 50Ω microstrip lines with the same length may be externally connected at the second port (12, 22) and the third port (13, 23) of the first hybrid ring coupler and the second hybrid ring coupler, respectively.

Of course, it is apparent to those of ordinary skill in the art that the impedance of the microstrip lines may also be other values, such as 60Ω, 75Ω, 100Ω, etc., which may be designed according to actual design requirements. The shape, the length, and other parameters of the microstrip lines may also be adjusted according to actual design requirements, and the shape of each microstrip line may be the same or different. The length of each microstrip line may be the same or different. The above embodiments are only for example and do not limit the protection scope of the present application.

The present application provides a trisection power divider with isolation, which ensures the isolation of the trisection power divider and the stable operation of the device by using the hybrid ring coupler with isolation to replace the commonly used Wilkinson power divider. The trisection power divider with isolation has simple structure, high performance, and is easy to layout and wiring.

The following is an example of a trisection power divider/combiner with X-band simulated frequencies of 9-10 GHz. The structural diagram of the simulation model is shown in FIG. 6.

Figure 7:
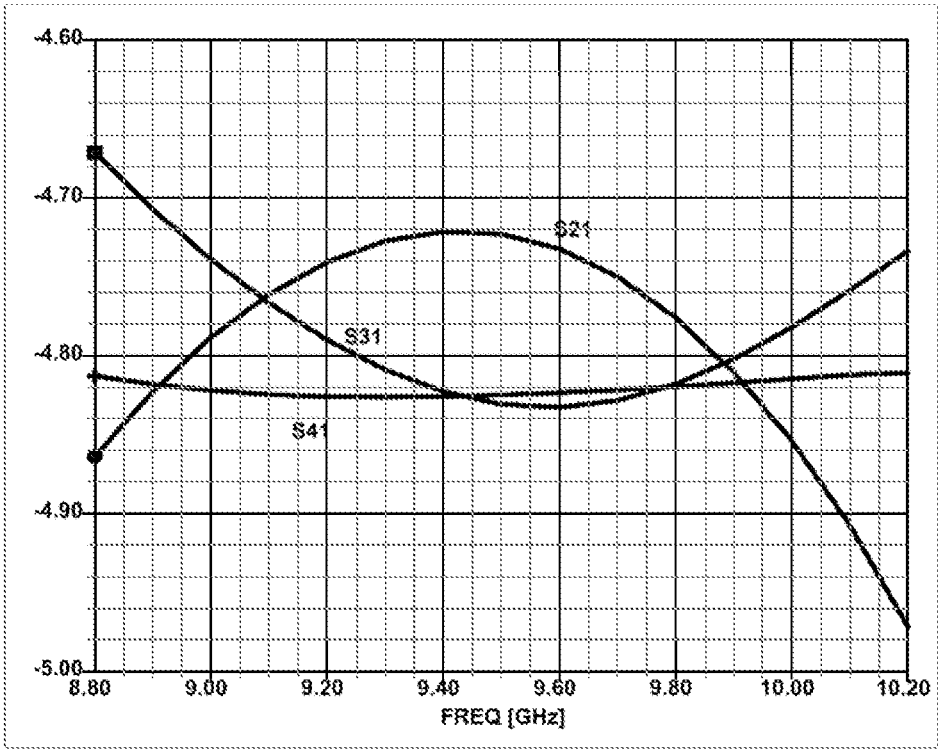
FIG. 7 is a simulation result schematic diagram of an insertion loss of a trisection power divider with isolation provided by one embodiment of the present application.
Figure 8:
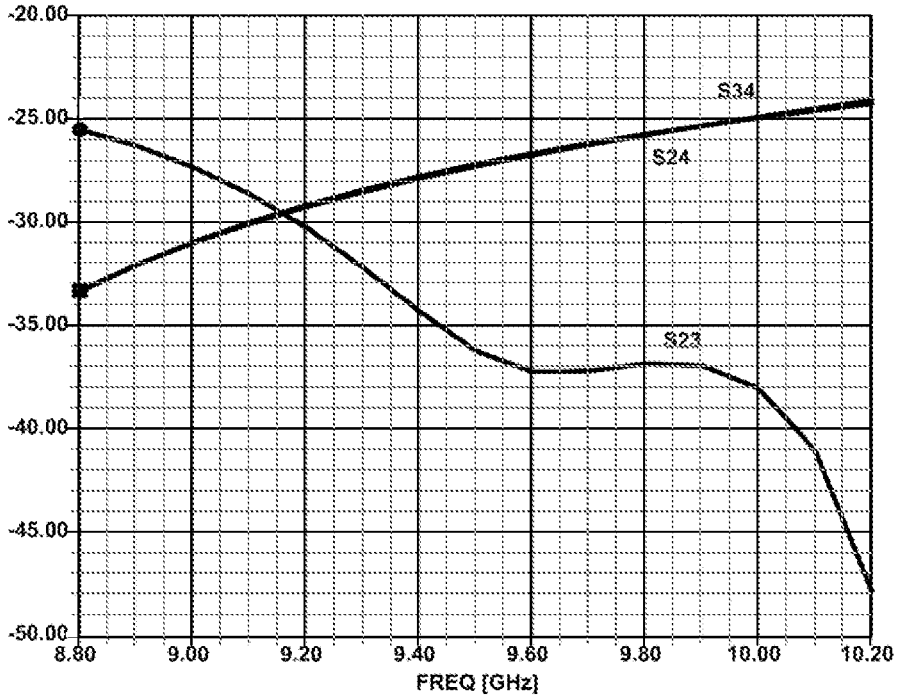
FIG. 8 is a simulation result schematic diagram of an isolation degree of a trisection power divider with isolation provided by one embodiment of the present application.

Among them, set Er=3.66 and the plate thickness to 0.508 mm. Where Er is the dielectric constant of the selected microwave dielectric plate. Port 1 is a common signal input port, while Port 2, Port 3, and Port 4 are three signal output ports, with input and output impedances of 50 ohms. Simulate the insertion loss and phase. The insertion loss simulation results are shown in FIG. 7, the phase simulation is shown in Table 1, and the isolation degree simulation results are shown in FIG. 8. S21, S31, S41, S23, S24, and S34 refer to the relationship between the two corresponding ports.

From the simulation results of insertion loss in FIG. 7, it can be seen that the insertion losses S21, S31, and S41 of the three signal output ports are all between 4.72 dB-4.83 dB, and the simulation results are similar to the theoretical value (−4.77 dB). There is a slight difference between S21, S41, and S31. From FIG. 7, it can be seen that the output of Port 2 and Port 3 has one more power allocation than Port 4, which will bring losses. If no other measures are taken, S21 and S31 will be smaller than S41. During simulation, in order to ensure that the output characteristics of the three ports are as consistent as possible, the power distribution ratio of the 1:2 hybrid ring coupler was optimized during parameter optimization, so that its power distribution ratio is not 1:2, but slightly deviates. This will correct the losses caused by power distribution of Port 2 and Port 3, and ultimately make the amplitude characteristics of the three ports as consistent as possible.

TABLE 1

| FREQ [GHz] | Ang(S21) [deg] | Ang(S31) [deg] | Ang(S41) [deg] |
|---|---|---|---|
| 9.00 | 61.81 | 60.51 | 56.89 |
| 9.10 | 48.31 | 47.68 | 44.97 |
| 9.20 | 34.80 | 34.86 | 33.05 |
| 9.30 | 21.29 | 22.03 | 21.14 |
| 9.40 | 7.77 | 9.19 | 9.21 |
| 9.50 | −5.77 | −3.65 | −2.72 |
| 9.60 | −19.33 | −16.52 | −15.67 |
| 9.70 | −32.91 | −29.40 | −28.64 |
| 9.80 | −46.53 | −42.32 | −40.66 |
| 9.90 | −60.18 | −55.27 | −53.72 |
| 10.00 | −73.87 | −68.26 | −65.88 |

Ang (S21), Ang (S31), Ang (S41) are the phases of the three signal output ports, and the phase deviation of the entire frequency band is ≤±4°. According to the vector synthesis rule, under the premise of consistent amplitude, the combined power efficiency caused by phase deviation is $\cos(\theta/2)=99.75\%$, such phase deviation has a relatively low impact on power combination efficiency and can be ignored.

From the simulation results of isolation degree in FIG. 8, it can be seen that the isolation degree between the three signal output ports in the entire frequency band is above 25 dB, achieving good inter channel isolation effect.

This power divider/combiner has good amplitude and phase consistency among the three outputs, high isolation between the three outputs, and easy layout and wiring implementation.

In addition, the present application also provides a microwave transmission system. When the output power of a single microwave active device cannot meet the demand in the microwave transmission system, it is necessary to perform multiple power combination or single power distribution. In cases where isolation is required, the above principle can be used as a trisection power combiner with isolation or trisection power divider with isolation. The microwave transmission system composed of the trisection power divider provided in this application has good isolation, good phase consistency of the three outputs, compact structure, and easy layout, which can improve the performance of the entire microwave transmission system.

The above embodiments are only used to illustrate the technical solution of the present application, not to limit it; although the present application has been described in detail with reference to the preceding embodiments, those skilled in the art should understand that they can still modify the technical solutions recorded in the preceding embodiments or replace some of the technical features equally; however, these modifications or replacements do not make the essence of the corresponding technical solutions separate from the spirit and scope of the technical solutions of the embodiments of the present application, and should be included in the scope of protection of the present application.

What is claimed is:

1. A trisection power divider with isolation comprising:

a first hybrid ring coupler with a distribution ratio of 1:2; and a second hybrid ring coupler with a distribution ratio of 1:1; and wherein a first port of the first hybrid ring coupler is a signal input port; a second port of the first hybrid ring coupler is connected with a first port of the second hybrid ring coupler; and a second port of the second hybrid ring coupler, a third port of the second hybrid ring coupler and a third port of the first hybrid ring coupler are three signal output ports of the trisection power divider; and the second port of the first hybrid ring coupler is a port with high power, and a fourth port of the first hybrid ring coupler and a fourth port of the second hybrid ring coupler are isolation ports.

2. The trisection power divider with isolation according to claim 1, wherein the first hybrid ring coupler and the second hybrid ring coupler are circular hybrid ring couplers.

3. The trisection power divider with isolation according to claim 1, wherein the first hybrid ring coupler is a first closed hybrid ring coupler, the first closed hybrid ring coupler comprising two arcs that are symmetrically arranged and two edges connected between the two arcs, the two arcs being a first arc and a second arc, and the two edges being a first edge and a second edge in parallel to each other; and the second port of the first hybrid ring coupler is arranged on the first edge and perpendicular to the first edge, and the third port of the first hybrid ring coupler is arranged on the second edge and perpendicular to the second edge; or the second hybrid ring coupler is a second closed hybrid ring coupler, the second closed hybrid ring coupler comprising two arcs that are symmetrically arranged and two edges connected between the two arcs, the two arcs being a first arc and a second arc, and the two edges being a first edge and a second edge in parallel to each other; and the second port of the second hybrid ring coupler is arranged on the first edge and perpendicular to the first edge, and the third port of the second hybrid ring coupler is arranged on the second edge and perpendicular to the second edge.

4. The trisection power divider with isolation according to claim 3, wherein the first port of the first hybrid ring coupler is arranged on the first arc or the second arc of the first hybrid ring coupler, and is aligned with a symmetry axis of the first arc or the second arc of the first hybrid ring coupler; and the second port of the first hybrid ring coupler and the third port of the first hybrid ring coupler are symmetrically arranged to the first port of the first hybrid ring coupler; or the first port of the second hybrid ring coupler is arranged on the first arc or the second arc of the second hybrid ring coupler, and is aligned with a symmetry axis of the first arc or the second arc of the second hybrid ring coupler; and the second port of the second hybrid ring coupler and the third port of the second hybrid ring coupler are symmetrically arranged to the first port of the second hybrid ring coupler.

5. The trisection power divider with isolation according to claim 4, wherein the fourth port of the first hybrid ring coupler and the third port of the first hybrid ring coupler are on a same edge of the first hybrid ring coupler; or the fourth port of the second hybrid ring coupler and the third port of the second hybrid ring coupler are on a same edge of the second hybrid ring coupler.

6. The trisection power divider with isolation according to claim 4, wherein the second port of the first hybrid ring coupler, the third port of the first hybrid ring coupler, the second port of the second hybrid ring coupler and the third port of the second hybrid ring coupler are directly connected with microstrip lines, respectively;

a first end of a first microstrip line of the microstrip lines connected with the second port of the first hybrid ring coupler is perpendicular to the first edge of the first hybrid ring coupler, and a second end of the first microstrip line is bent away from the first port of the first hybrid ring coupler;

a first end of a second microstrip line of the microstrip lines connected with the third port of the first hybrid ring coupler is perpendicular to the second edge of the first hybrid ring coupler, and a second end of the second microstrip line is bent away from the first port of the first hybrid ring coupler;

a first end of a third microstrip line of the microstrip lines connected with the second port of the second hybrid ring coupler is perpendicular to the first edge of the second hybrid ring coupler, and a second end of the third microstrip line is bent away from the first port of the second hybrid ring coupler; and a first end of a fourth microstrip line of the microstrip lines connected with the third port of the second hybrid ring coupler is perpendicular to the second edge of the second hybrid ring coupler, and a second end of the fourth microstrip line is bent away from the first port of the second hybrid ring coupler.

7. The trisection power divider with isolation according to claim 6, wherein the first port of the first hybrid ring coupler, the fourth port of the first hybrid ring coupler, the first port of the second hybrid ring coupler and the fourth port of the second hybrid ring coupler are externally connected with 50Ω microstrip lines, respectively.

8. The trisection power divider with isolation according to claim 7, wherein the first microstrip line, the second microstrip line, the third microstrip line and the fourth microstrip line are 50Ω microstrip lines of a same length.

9. The trisection power divider with isolation according to claim 6, wherein the first microstrip line, the second microstrip line, the third microstrip line and the fourth microstrip line are 50Ω microstrip lines of a same length.

10. A microwave transmission system, wherein the microwave transmission system comprises a trisection power divider with isolation, and the trisection power divider with isolation comprises:

a first hybrid ring coupler with a distribution ratio of 1:2; and a second hybrid ring coupler with a distribution ratio of 1:1; and wherein a first port of the first hybrid ring coupler is a signal input port; a second port of the first hybrid ring coupler is connected with a first port of the second hybrid ring coupler; and a second port of the second hybrid ring coupler, a third port of the second hybrid ring coupler and a third port of the first hybrid ring coupler are three signal output ports of the trisection power divider; and the second port of the first hybrid ring coupler is a port with high power, and a fourth port of the first hybrid ring coupler and a fourth port of the second hybrid ring coupler are isolation ports.

11. The microwave transmission system according to claim 10, wherein the first hybrid ring coupler and the second hybrid ring coupler are circular hybrid ring couplers.

12. The microwave transmission system according to claim 10, wherein the first hybrid ring coupler is a first closed hybrid ring coupler, the first closed hybrid ring coupler comprising two arcs that are symmetrically arranged and two edges connected between the two arcs, the two arcs being a first arc and a second arc, and the two edges being a first edge and a second edge in parallel to each other; and the second port of the first hybrid ring coupler is arranged on the first edge and perpendicular to the first edge, and the third port of the first hybrid ring coupler is arranged on the second edge and perpendicular to the second edge; or the second hybrid ring coupler is a second closed hybrid ring coupler, the second closed hybrid ring coupler comprising two arcs that are symmetrically arranged and two edges connected between the two arcs, the two arcs being a first arc and a second arc, and the two edges being a first edge and a second edge in parallel to each other; and the second port of the second hybrid ring coupler is arranged on the first edge and perpendicular to the first edge, and the third port of the second hybrid ring coupler is arranged on the second edge and perpendicular to the second edge.

13. The microwave transmission system according to claim 12, wherein the first port of the first hybrid ring coupler is arranged on the first arc or the second arc of the first hybrid ring coupler, and is aligned with a symmetry axis of the first arc or the second arc of the first hybrid ring coupler; and the second port of the first hybrid ring coupler and the third port of the first hybrid ring coupler are symmetrically arranged to the first port of the first hybrid ring coupler; or the first port of the second hybrid ring coupler is arranged on the first arc or the second arc of the second hybrid ring coupler, and is aligned with a symmetry axis of the first arc or the second arc of the second hybrid ring coupler; and the second port of the second hybrid ring coupler and the third port of the second hybrid ring coupler are symmetrically arranged to the first port of the second hybrid ring coupler.

14. The microwave transmission system according to claim 13, wherein the fourth port of the first hybrid ring coupler and the third port of the first hybrid ring coupler are on a same edge of the first hybrid ring coupler; or the fourth port of the second hybrid ring coupler and the third port of the second hybrid ring coupler are on a same edge of the second hybrid ring coupler.

15. The microwave transmission system according to claim 13, wherein the second port of the first hybrid ring coupler, the third port of the first hybrid ring coupler, the second port of the second hybrid ring coupler and the third port of the second hybrid ring coupler are directly connected with microstrip lines, respectively;

a first end of a first microstrip line of the microstrip lines connected with the second port of the first hybrid ring coupler is perpendicular to the first edge of the first hybrid ring coupler, and a second end of the first microstrip line is bent away from the first port of the first hybrid ring coupler;

a first end of a second microstrip line of the microstrip lines connected with the third port of the first hybrid ring coupler is perpendicular to the second edge of the first hybrid ring coupler, and a second end of the second microstrip line is bent away from the first port of the first hybrid ring coupler;

a first end of a third microstrip line of the microstrip lines connected with the second port of the second hybrid ring coupler is perpendicular to the first edge of the second hybrid ring coupler, and a second end of the third microstrip line is bent away from the first port of the second hybrid ring coupler; and a first end of a fourth microstrip line of the microstrip lines connected with the third port of the second hybrid ring coupler is perpendicular to the second edge of the second hybrid ring coupler, and a second end of the fourth microstrip line is bent away from the first port of the second hybrid ring coupler.

16. The microwave transmission system according to claim 15, wherein the first port of the first hybrid ring coupler, the fourth port of the first hybrid ring coupler, the first port of the second hybrid ring coupler and the fourth port of the second hybrid ring coupler are externally connected with 50Ω microstrip lines, respectively.

17. The microwave transmission system according to claim 16, wherein the first microstrip line, the second microstrip line, the third microstrip line and the fourth microstrip line are 50Ω microstrip lines of a same length.

18. The microwave transmission system according to claim 15, wherein the first microstrip line, the second microstrip line, the third microstrip line and the fourth microstrip line are 50Ω microstrip lines of a same length.

* * * * *